United States Patent [19]

Zaretti

[11] 4,073,148

[45] Feb. 14, 1978

[54] PRECAST ELEMENT FOR THE CONSTRUCTION OF TRENCHED STRUCTURES AND THE PROCESS RELATED THERETO

[76] Inventor: Luigi Zaretti, Milan, Italy

[21] Appl. No.: 631,088

[22] Filed: Nov. 12, 1975

[30] Foreign Application Priority Data

Nov. 12, 1974 Italy ..... 29319/74

[51] Int. Cl.[2] ..... E01G 4/02

[52] U.S. Cl. ..... 61/42; 61/41 R

[58] Field of Search ..... 61/44, 45 R, 41 R, 41 A, 61/84; 52/602, 169

[56] References Cited

U.S. PATENT DOCUMENTS

| | | | |
|---|---|---|---|
| 922,768 | 5/1909 | Jackson | 61/44 |
| 1,948,114 | 2/1934 | Janssen | 61/44 X |
| 2,294,554 | 9/1942 | Henderson | 52/602 X |
| 2,559,198 | 7/1951 | Ogden | 52/585 X |
| 3,546,830 | 12/1970 | Villaneau | 52/602 X |
| 3,914,946 | 10/1975 | Bingham et al. | 404/71 X |

FOREIGN PATENT DOCUMENTS

| | | | |
|---|---|---|---|
| 418,703 | 3/1947 | Italy | 61/44 |

*Primary Examiner*—Dennis L. Taylor

[57] ABSTRACT

Structures are installed below grade by trenched construction. Precast wall elements, having a generally rectangular-shaped wall with at least one of its faces having essentially vertically-oriented parallel ribs, are placed in mud-filled trenches. Liquid concrete is then poured between the ribs to provide a foundation and to secure the wall element to the ground.

12 Claims, 39 Drawing Figures

FIG. 1
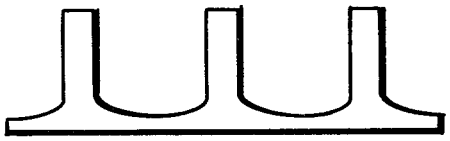
FIG. 2
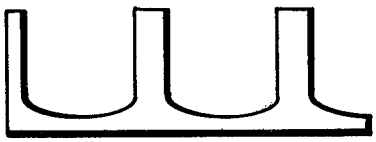
FIG. 3
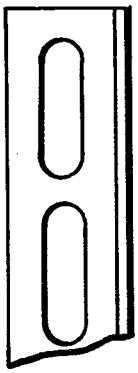
FIG. 4
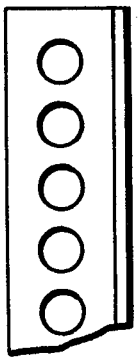
FIG. 5
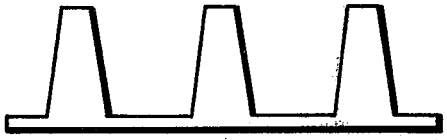
FIG. 6
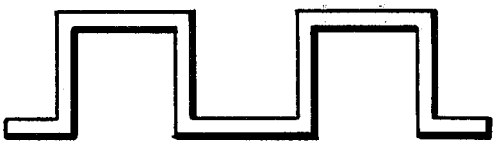
FIG. 7
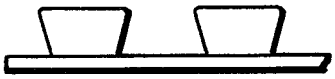
FIG. 8
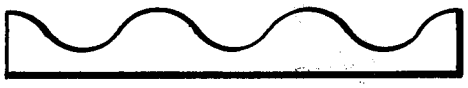
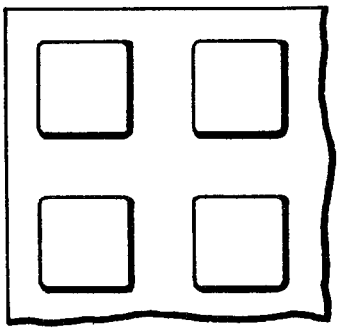
FIG. 7'

FIG. 10A
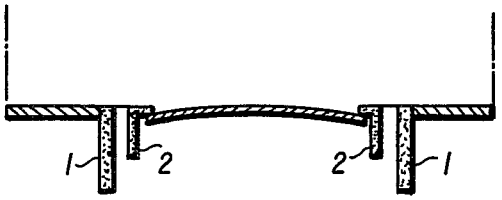
FIG. 10B
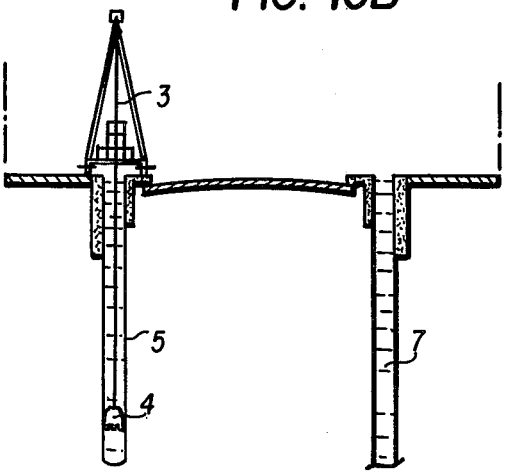
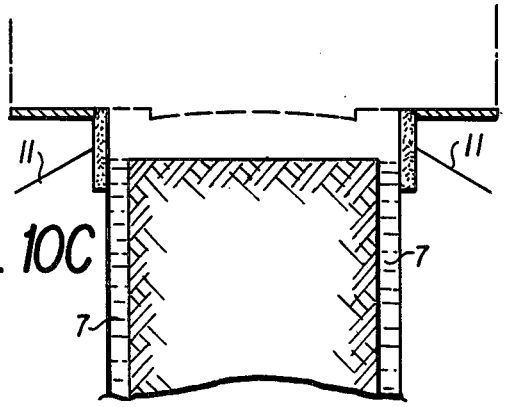
FIG. 10C
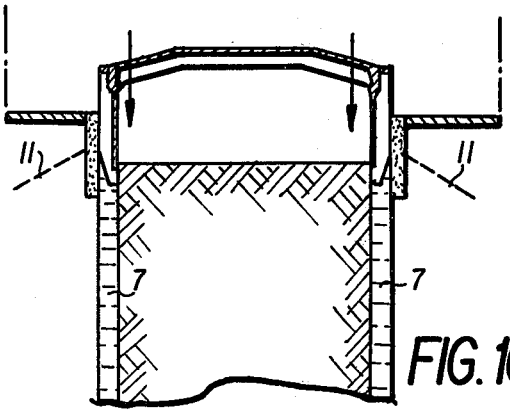
FIG. 10D
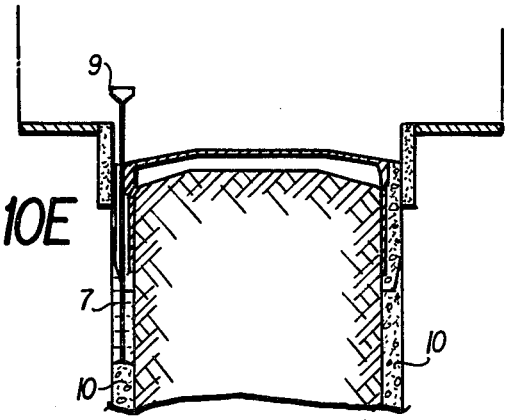
FIG. 10E
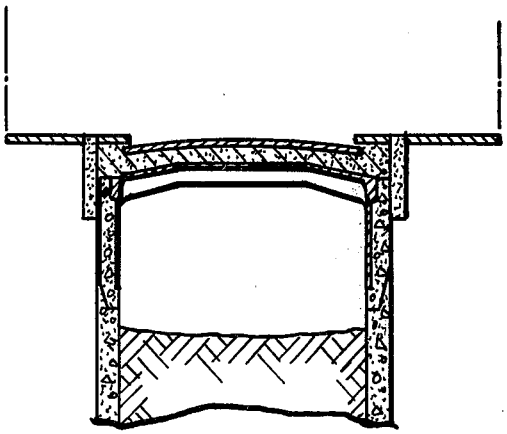
FIG. 10F
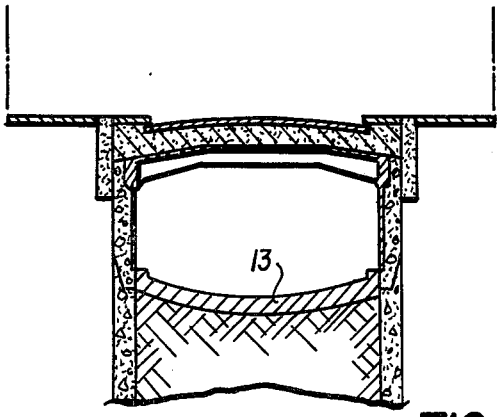
FIG. 10G FIG. 11A
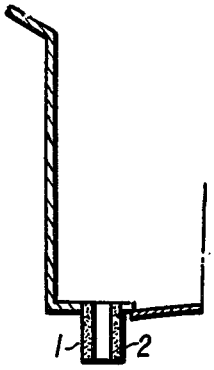
FIG. 11B
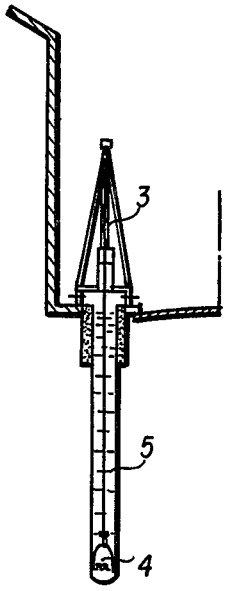
FIG. 11C
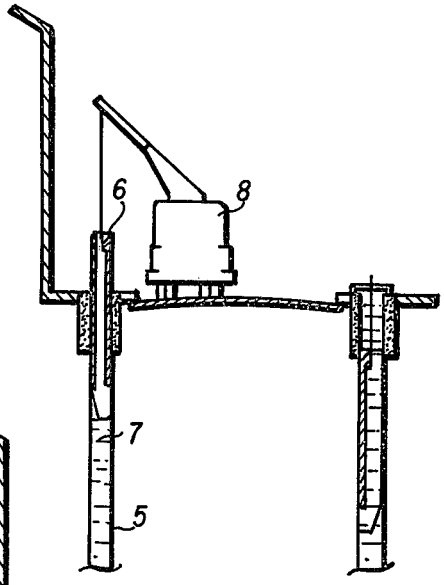
FIG. 11D
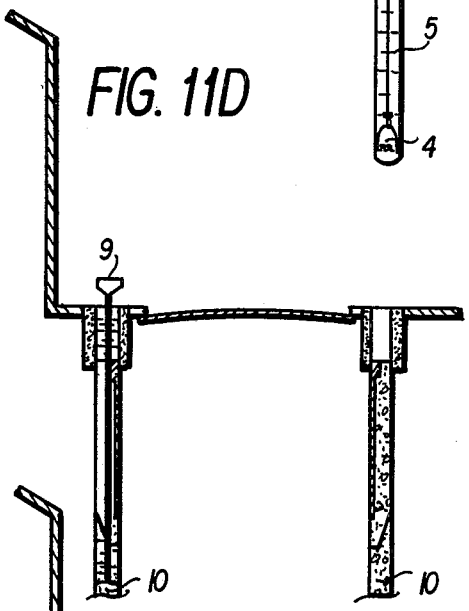
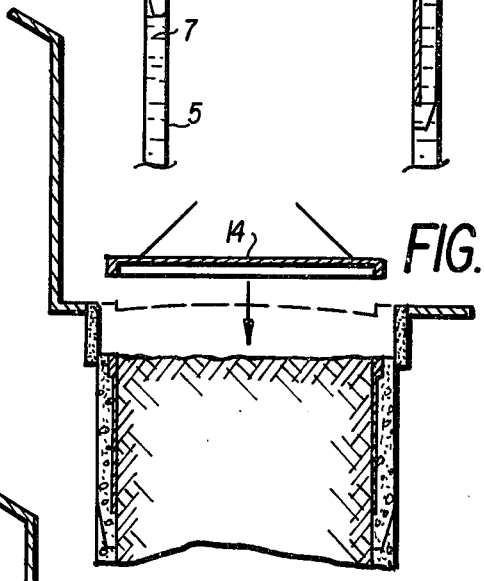
FIG. 11E
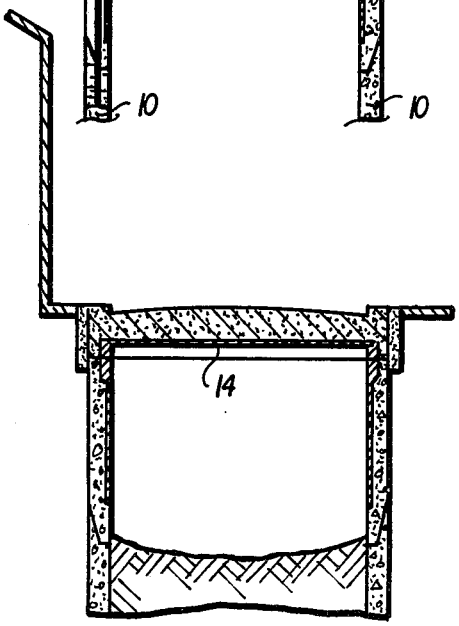
FIG. 11F
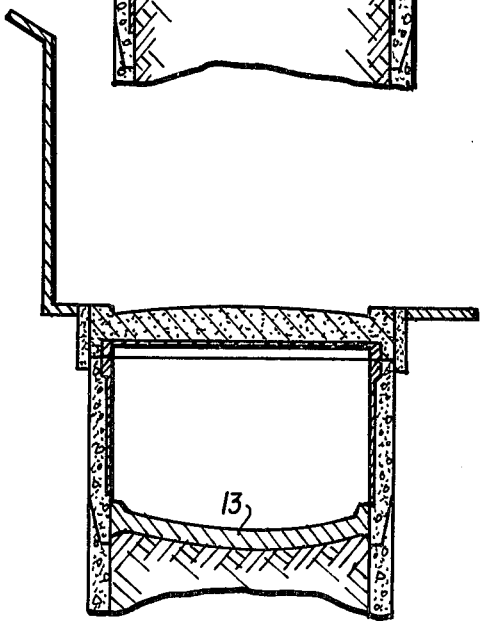
FIG. 11G FIG. 14 A
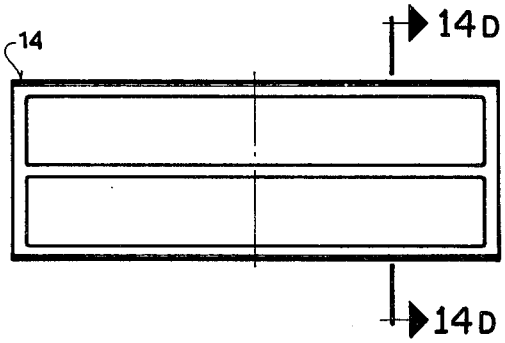
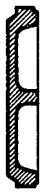
FIG.14 D
FIG. 14 B
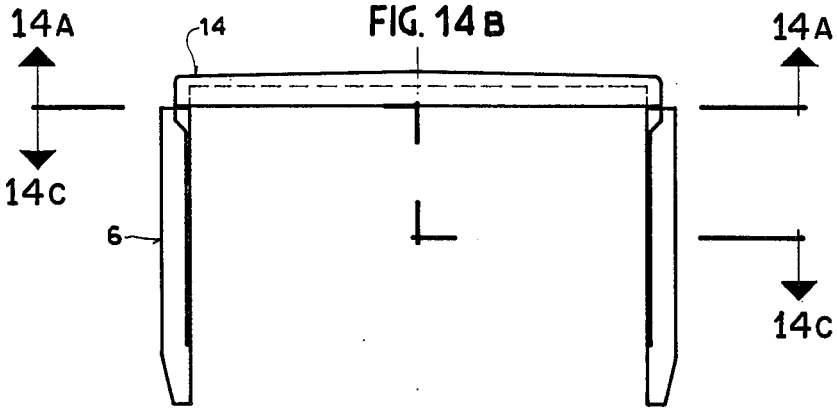
FIG. 14 C
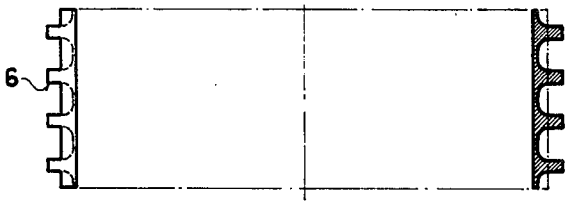

PRECAST ELEMENT FOR THE CONSTRUCTION OF TRENCHED STRUCTURES AND THE PROCESS RELATED THERETO

The present invention is concerned with precast reinforced concrete elements with parallel, or essentially parallel, ribs, for the construction of trenched structures, such as retaining walls, tunnels, or similar structures.

The invention is equally concerned with the process involved in the construction of these structures, as well as with installations, or structures, built in like manner.

Processes known up to this point in time, and those generally adopted for the construction of below-grade walls, more particularly known as "poured walls," involve digging trenches, or shafts, in the ground, deepended by forcing down bentonite muds, which serve to stabilize the walls and thus avoid cave-ins, then filling them with concrete, with, or without, reinforcing bars. This process was widely used, for example, in 1958, and in subsequent years, in the construction of the tunnels for the Milan subway, as well as for digging the large clearing excavations near buildings, using, among other things, hidden tie-rods attached to the walls and anchored in the ground in the case of great depth. Once the walls were poured, using concrete as indicated above, the next step in such cases was to pour the caps, or the reinforced concrete floors, on the spot.

Along about 1970, and in the years that have followed, there have been several processes developed, the purpose of which is to permit the use of precast elements for building walls. But these processes are, in general, conditioned by the need to use complex mixtures, also called "self-hardening," in place of the ordinary bentonite muds, and concrete, respectively, for purposes of stabilizing the excavations, and for anchoring the precast elements in the ground, or for the fabrication of the foundation block below these elements. These mixtures are, in general, composed of bentonite, cement, and various additives in suspension in water, in proportions such that these mixtures are fluid enough so that the precast elements can be immersed in the excavation when the mixture is fresh, but such that this mixture will, at the end of some particular setting up time, be sufficiently set up to provide strength of the order of 30 kg/cm$^2$.

It is obvious that if this process offers the advantage with respect to the traditional technique described above, of permitting the use of precast elements, it still has just as many complications because as has been pointed out, it requires the use of complex mixtures in place of the ordinary bentonite mud and concrete. Furthermore, experimental data of sufficient depth on the subject of the behavior of these mixtures are still lacking, and there are grounds too for the observation that these mixtures result, upon setting up, in a mass, the strength of which is clearly inferior to that of ordinary concrete, strength that could be insufficient in many cases. Moreover, these processes do not result in a statically homogeneous and monolithic structure (foundations, precast elements, fill), with the result that the entire stress must be borne exclusively by the precast element, and, as a result, this latter must be very heavy. This, moreover, means that in the majority of cases the precast element must be supported by tie-rods anchored in the ground.

The drawbacks cited above can be eliminated by the precast elements that are the subject of the invention, and by the process involved in building the structures with these elements.

The other advantages will become clear to the engineer from the following description.

The precast elements that are the subject of the invention consist of a generally rectangular reinforced concrete wall, at least one face of which has essentially parallel ribs, hollows, and undulations, all forms comprised, for simplicity sake, in the term ribs, the dimensions of which are adequate for pouring the concrete for the lateral support, and, as occasion warrants, for the foundation for these precast elements.

It is obvious that these ribs, hollows, and undulations, which can take a variety of shapes, as will be pointed out in more detail in what follows, considerably lighten the precast element, and create, in particular, as has already been indicated in part, once the precast element has been set up in the excavation and placed such that the ribs are disposed vertically, or very nearly vertical, reinforcements, or passages, with dimensions adequate for pouring the concrete into the excavation itself, from below (to form the foundations for the precast element) or at the back of the precast element, and precisely between the latter and the ground. And this by means of immersed injection pipes which, conforming to the traditional method already recalled, route the concrete into place, pushing the bentonite mud toward the top little, and thus avoiding any change by becoming mixed in with this mud. Finally, the ribs, in addition to the fact that they first and foremost perform the function pointed out above, produce a precast element that is integral with the concrete casting for static purposes, with the result that this element can be, as has already been mentioned, much lighter than, and equal in strength to, the precast elements used with the other processes known to date.

For purposes of attaining these objectives in the best possible way, the ribs can be given different profiles, they can have holes, or slots, as well as protruding reinforcing bars, suitable arranged; that is, they can be adapted to the different procedures already practiced in this field in accordance with the traditional technique.

This applies as well to the various devices used to make the most perfect watertight connections between two successive elements, devices that can be adopted in case of need, and which already are well known.

The process according to the invention, which is best suited for making the most of the precast elements defined above, is less complicated than those described in the foregoing, because it is based on the use of ordinary bentonite mud to stabilize the ground during the excavation period, and of ordinary concrete to simultaneously pour the foundations and the filling for the precast elements. In addition, the concrete ultimately concords with the strength of the precast elements with which it is integral, and this permits the use of much lighter structures for the precast elements themselves.

While permitting the reaching of the desired goal, that is, the use of precast construction elements, the preferred process, the one that will be described hereinafter, is less complicated than the known processes, those placed in question above. In particular, it conforms more closely to the traditional technique, and, as a result, is easier to carry out by any enterprise equipped for work of this type.

More specifically, the process of the invention includes the following successive phases:

(a) digging and surface pouring of the concrete guide cordons;

(b) digging trenches with valve buckets, the trenches conforming to the desired depth when bentonite muds are forced in (the width of the trench is normalized at 50, 60, or 80 cm);

(c) placement in the trenches thus excavated of the precast elements described above, immersing them vertically in the bentonite mud with which the trench is filled, and suspending them at the desired depth. These elements will be installed in a manner such that their ribs are disposed vertically, and their smooth wall is facing contrary to the ground because this is the side that will ultimately be visible;

(d) pouring of ordinary fluid concrete in the liquid state into the trenches until they are full, and thus forming the foundations underlying the precast elements and the lateral support for them to the top. This pouring of the concrete is done by using pipes submerged in advance in the bentonite mud and running the length of the vertical, or nearly vertical, spaces that exist between the successive ribs of the precast element. It obviously is possible, and it is anticipated, that reinforcing bars can be used in this phase according to possible static needs during the pouring of the concrete.

Operations (a) and (b) are known, since they are part of the traditional process. On the other hand, operation (c), and, to a lesser degree, operation (d), are typical of the present invention, which is distinct from other known processes by the use of characteristically ribbed precast elements shaped so as to permit the pouring of the foundations immobilization with the concrete in a single phase. This obviously presents a definite advantage.

In the case of the construction of plain walls, those designed, for example, to support embankments operation (d) can be followed by one consisting of digging a cut on one side, the smooth walls of the precast elements remaining exposed once the structure is completed. In case of need, the tie-rods used for anchors can be installed during this phase. On the other hand, in the case of tunnels, the invention envisages the installation in one piece of monolithic precast portal elements the maximum dimensions of which are those permitted by traffic regulations for the case where the precasting plant is not close to the site where the structure will be used, or in three parts, two of which comprise the lateral walls, and the third forms the cap, in the case where special local access difficulties exist. In either case, the element is characteristic, and consists of the lateral walls, which are ribbed and shaped in accordance with the description given on the subject of retaining walls.

In the first hypothesis, that is, in the case where monolithic precast portal elements are to be used, operation (d) is followed by operation (e), which consists of clearing the ground between the two trenches to the height of the tunnel intrados, as well as by the following operations:

(f) covering the cap and, in case of need, restoration of the road cover;

(g) below-grade trenching to the height necessary to build the floor of the tunnel;

(h) construction of the floor, or of the foundation arch, for the tunnel.

In the case of tunnels built using elements precast in three parts, that is, composed of two wall elements and a cap, operation (d) is followed by operation (e), which consists of clearing the ground as indicated above, by operation (e') consisting of placing, and sealing in place, the precast elements comprising the cap, then successively by operations (f), (g), and (h), as questioned in the preceding case.

It stands to reason that the process that is the subject of the invention results in a substantial reduction in execution time, as compared to the traditional operative mode, particularly where tunnels are concerned, and this is of fundamental importance when work must be done, in particular, in urban areas. Indeed, this process virtually eliminates waiting time for the concrete to set up, as well as all further intervention, either for exterior finishing, particularly for waterproofing, or for interior finishing of visible walls.

In another connection, there is reason to emphasize as particularly important the total elimination of straightening work, something that is always necessary at the top of normal walls poured on the spot, as well as the elimination of form work, something that generally requires the use of noisy pneumatic tools, for the sockets for the cap grinders. In another connection, one can, with the precast elements of the invention, arrive at a much more efficient, and practically perfect, waterproofing in the case where these structures must be installed below the level of the underground water. The surfaces of the visible walls will be smooth and finished as a result of the excavation corresponding to operation (g), and there will be no need for further regularization, or plastering.

It is obvious that the process of the invention can be applied to the construction of tunnels, canals, or underpasses, of whatever type, of any dimensions, and of above-ground preference, or even for putting up isolated structures, such as precast reinforced cement pillars, in place of those built using the ordinary processes of pouring reinforced concrete on the spot.

The invention is illustrated hereinafter by the following figures and in the form of a nonlimiting example.

FIGS. 1, 2 and 5 are plan view of ribbed precast elements according to the invention. The element in FIG. 2, which is suitable for building curved alignments, can have its ribs lightened by circular or oblong holes, such as those shown in FIGS. 3 and 4. These circular or oblong holes provide better anchorage for the concrete poured into the precast structure, which then has greater static strength.

FIG. 6 is a plan view of a precast element, the two faces of which are undulated.

FIGS. 7 and 7' are, respectively, the plan and elevation views of parts of a precast element with recesses.

FIG. 8 is the plan view of a precast element with an undulating profile.

Figure 9A:
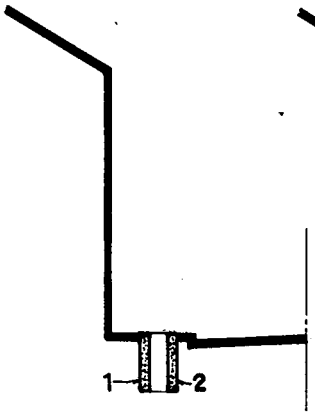
FIGS. 9A through 9E illustrate the different phases of the work involved in building a retaining wall from precast elements according to the process of the present invention.
Figure 9B:
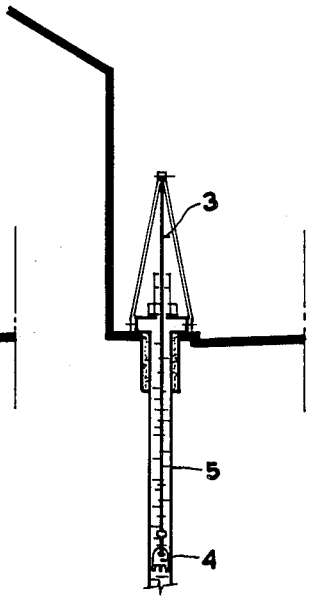
Figure 9C:
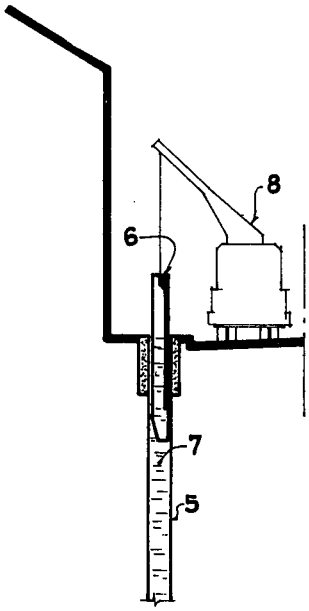
Figure 9D:
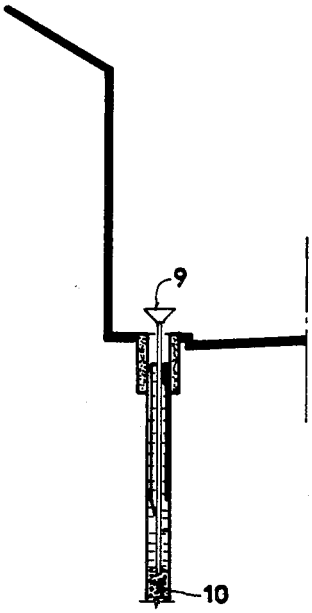
Figure 9E:
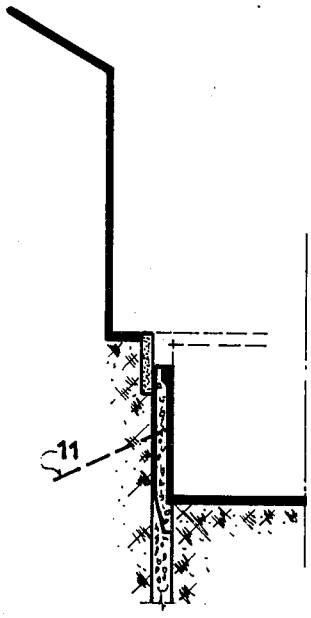
Figure 12A:
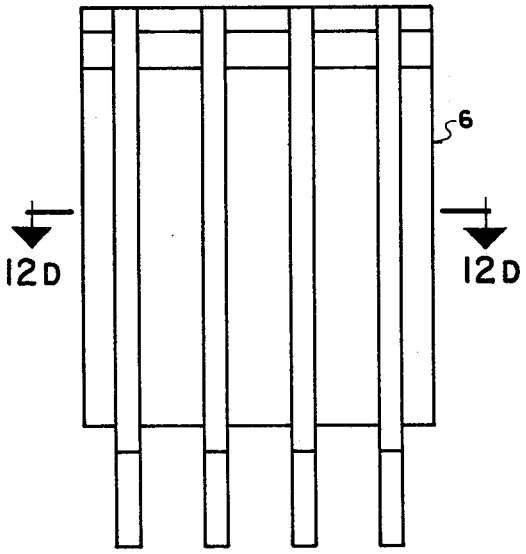
Figure 12B:
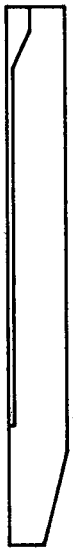
Figure 12C:
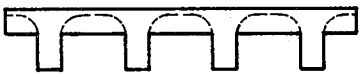
Figure 12D:
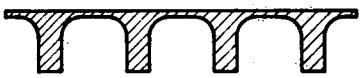
Figure 13A:
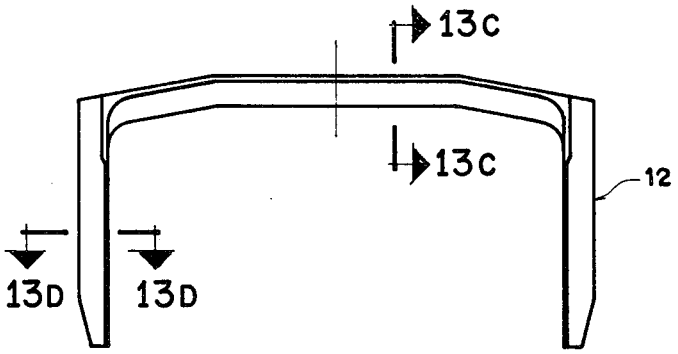
Figure 13B:
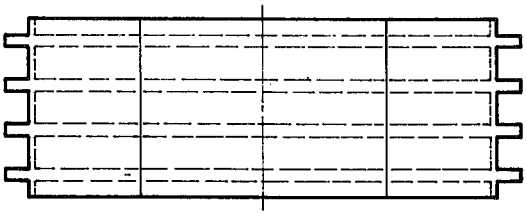
Figure 13C:
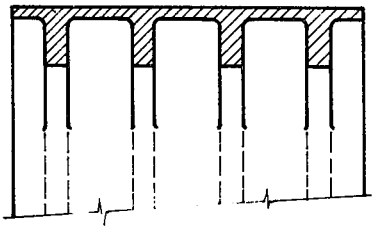
Figure 13D:
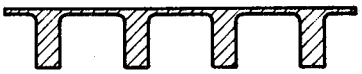

FIG. 9A is a schematic presentation of the first phase of the process, and consists of the forming of the concrete guide cordons, 1 and 2. FIG. 9B shows the excavator, 3, equipped with a bucket, 4, digging trench 5. FIG. 9C represents that phase of the operation involving the placement of a precast element, 6, in the trench filled with an aqueous bentonite suspension, 7. FIG. 9D represents that phase of the operation involved with pouring the concrete, 10, using a funnel pipe, 9, the lower end of which is raised during the pouring process, at the same time that the precast element is held firmly until setting has been achieved. FIG. 9E represents the wall as a result of clearing, with 11 designating a possible tie-rod.

FIGS. 10A through 10G illustrate the different phases of the work involved in the construction of a tunnel from precast elements made in monolithic portal form in accordance with the process of the present invention. Most specifically, the construction of the tunnel begins (FIG. 10A) with the formation of two pairs of guide cordons, 1 and 2. Among the other phases to be pointed out is the fitting of the portal element, 12 (FIG. 10D), in the two trenches filled with an aqueous suspension of bentonite, 7, which then is replaced by concrete, 10, and the phases shown in FIGS. 10F and 10G, which involve covering the cap and doing the below-grade excavation to the level of the floor, or foundation arch, as well as pouring this latter, 13.

In the case where there is reason to make altimetric or planimetric road curves, one can adopt the known arrangement consisting of inserting, between one element and the next, suitably shaped, rigid, reinforced cement sections, or elastic inserts made of a variety of materials, such as rubber, for example, or even to combine suitable trapezoidal elements between time.

FIGS. 11A through 11G show different phases of the work involved in the construction of a tunnel from three precast elements in accordance with the process of the present invention. The different phases are clearly illustrated by the figures and need no comment.

EXAMPLE 1 — Construction of a retaining wall.

It is anticipated that precast elements, all alike, different views of which will be seen in FIGS. 12A through 12D, and in section 1—1, will be used to build a retaining wall.

In this particular case, these elements consist of a slab 3.50 m high, 3.00 wide, with a minimum thickness of 5 cm, fitted with ribs 4.50 m high and 20 cm thick, spaced 75 cm apart. These ribs delimit the U-shaped exterior hollows. It is precisely by way of these hollows, arranged vertically, that the liquid concrete for filling the trench, and for forming simultaneously the foundations for the precast element and the lateral support for this latter, is poured through a special immersed pipe fitted with a top funnel.

It is anticipated, in the case presented here, that there will be light reinforcement only at the level of the joints between the different elements of the precast wall, in particular for purposes of forming efficient supports for carrying the possible concentrated loads that are transmitted by the cap beams, or by the floors.

Each element of a wall of the type described weighs 7.3 t, that is, of the order of 0.5 t/m$^3$.

Thanks to the use of these precast elements in the form of a ribbed slab, and also to the possibility of using metal reinforcements throughout the height, it is obvious that the static behavior of completely installed side walls is more stable and better defined as compared to those obtained by using flat slabs, and is true in particular of bending moments in the vertical plane attributable to the thrust of the ground, although their weight is very much less than that of flat precast slab, that is, of slabs without ribs.

EXAMPLE 2 — Construction of a subway tunnel, double- or single-track, with precast portal elements.

Monolithic precast portal elements have been adopted for the construction of a specially designed tunnel for a double-tracked subway.

These elements, also ribbed, are shown in different views in FIGS. 13A through 13D, and section 1—1, and have a span of 7.80 m, a height at the peak of 4.50 m, and a width of 3.00 m. These dimensions are, in general, compatible with those required for transportation.

The lateral walls are made of slabs with a minimum thickness of 5 cm, fitted with ribs 20 cm thick, spaced 60 cm between axes. These ribs delimit the exterior vertical hollows, into which the concrete is poured through a pipe fitted with a funnel, in the manner already described. The cap consists of a 10 cm thick slab made with 20 cm thick ribs, spaced 75 cm apart on the axes. It too is completely precast, but can have a different shape, depending on the most current types of precasting in use.

The weight of each monolithic precast portal element for a single-tracked tunnel obviously is less. A linear meter weighs from 5 to 7 tons, approximately, and a 3 m long element, for example, thus will weigh from 15 to 21 tons.

These weights exceed somewhat those of the elements adopted by the norms in the precasting of those most current in a building, but they are very much less than those of the elements habitually used in industrial precasting, for modern bridges, viaducts, and highway and railroad construction, for example; that is, in the sector closest to that in which the structures with which we are concerned here are used.

But there are difficulties that can be envisaged in certain cases because of the obstruction, particularly in height, created during the transportation of portal elements. These difficulties are practically nonexistant when separate precast elements (side walls and cap) designed to be assembled on the spot, elements designed as a variant with these possible difficulties in mind, are used. This type of construction is illustrated by Example 3, below.

EXAMPLE 3 — Construction of a subway tunnel with three separate precast elements (walls and caps).

FIGS. 14A through 14C, and section 1—1, show the three precast elements, two ribbed walls and a cap, in different views, for the construction of single-track subway tunnels. Double-track tunnels can be built in exactly the same way, with the exception of their greater width, and there is no need to show them in detail.

I claim:

1. Precast reinforced concrete element for trench construction of structures such as retaining walls and tunnels comprising:

a generally rectangular-shaped wall with at least one of its faces having essentially parallel ribs extending outwardly from the surface of the wall and defining separate volume areas between the base of the wall, the two adjacent ribs and a plane tangent to the outer extension of each rib, said ribs being spaced apart to permit the pouring of liquid concrete down between adjacent ribs for the foundation of said element below said element and to permit the pouring of concrete in between the ribs to provide lateral support for the wall by filling said volume areas.

2. An element according to claim 1, wherein said ribs have a height of at least 25 cm.

3. An element according to claim 1, wherein said ribs are provided with slots which lighten the element and aid in producing an element integral with the concrete casting.

4. An element according to claim 1, comprising two laterally spaced walls and connecting top element to form a monolithic portal.

5. An element according to claim 1, wherein said element comprises two laterally spaced ribbed walls and a connecting cap.

6. A process for installing structures below-grade by trenched construction comprising:

(a) forming guide cordons by excavating guide trenches which are then filled with concrete;

(b) excavating main trenches of the desired depth between and below the guide cordons and filling said trenches with mud;

(c) placing in said mud-filled main trenches precast wall elements having a generally rectangular-shaped wall with at least one of its faces having essentially vertically-oriented parallel ribs; and (d) pouring liquid concrete into the bottom of the trenches and continuing to fill the trenches including the area adjacent the ribbed wall.

7. A process according to claim 6, wherein said trenches have supplementary metal reinforcements.

8. A process according to claim 6, wherein said ribs are on the outside of said wall.

9. A process according to claim 6, wherein said mud is bentonite mud.

10. A process according to claim 6, wherein said installation is a simple wall and said processing includes the subsequent excavation of the ground against the flat side of the precast element.

11. A process according to claim 6, wherein said installation is a tunnel comprising a precast monolithic portal element comprising two laterally spaced walls and a connecting cap and further comprising the steps of:

covering the cap;

excavating below-grade to a depth needed to build the tunnel floor; and constructing a floor or a foundation arch for the tunnel.

12. A process according to claim 6, wherein said installation is a tunnel comprising elements cast in three parts with two parts forming laterally spaced walls and the third part comprising a connecting cap, said method further comprising:

excavating, after the concrete has set up in said trenches, the ground between the two trenches to the height of the tunnel intrados;

placing said sealing of the part forming the cap;

covering the cap;

excavating below-grade to the depth required to build the floor of the tunnel; and constructing the floor or the foundation arch for the tunnel.

* * * * *

UNITED STATES PATENT AND TRADEMARK OFFICE

CERTIFICATE OF CORRECTION

PATENT NO. : 4,073,148

DATED : February 14, 1978

INVENTOR(S) : Luigi Zaretti

It is certified that error appears in the above-identified patent and that said Letters Patent are hereby corrected as shown below:

After "[76] Inventor: Luigi Zaretti, Milan, Italy" insert -- [73] Assignee: Alpina S.p.A., Milan, Italy --

Signed and Sealed this

*Third* Day of *October 1978*

[SEAL]

*Attest:*

RUTH C. MASON
*Attesting Officer*

DONALD W. BANNER
*Commissioner of Patents and Trademarks*